US009741330B2

(12) United States Patent
Tu et al.

(10) Patent No.: US 9,741,330 B2
(45) Date of Patent: Aug. 22, 2017

(54) DUAL-DIAPHRAGM MICROPHONE MODULE TO REDUCE VIBRATION NOISE

(71) Applicant: Acer Incorporated, New Taipei (TW)

(72) Inventors: Po-Jen Tu, New Taipei (TW); Jia-Ren Chang, New Taipei (TW); Ming-Chun Yu, New Taipei (TW); Ming-Chung Fang, New Taipei (TW)

(73) Assignee: Acer Incorporated, New Taipei (TW)

( * ) Notice: Subject to any disclaimer, the term of this patent is extended or adjusted under 35 U.S.C. 154(b) by 34 days.

(21) Appl. No.: 14/261,547

(22) Filed: Apr. 25, 2014

(65) Prior Publication Data

US 2015/0078565 A1 Mar. 19, 2015

(30) Foreign Application Priority Data

Sep. 13, 2013 (TW) ..... 102133284 A

(51) Int. Cl.

| | |
|---|---|
| ***H04R 1/24*** | (2006.01) |
| ***H04R 19/04*** | (2006.01) |
| ***G10K 11/16*** | (2006.01) |
| ***H04R 3/02*** | (2006.01) |
| ***H04R 1/04*** | (2006.01) |
| ***H04R 7/00*** | (2006.01) |
| *H04R 1/28* | (2006.01) |

(52) U.S. Cl.

CPC ..... *G10K 11/16* (2013.01); *H04R 1/04* (2013.01); *H04R 3/02* (2013.01); *H04R 7/00* (2013.01); *H04R 1/2869* (2013.01); *H04R 2499/11* (2013.01); *H04R 2499/15* (2013.01)

(58) Field of Classification Search

CPC ..... H04R 3/005; H04R 1/406; H04R 1/38; H04R 2410/07; H04R 1/2869; H04R 7/00; H04R 7/04; G10K 2210/506

USPC ..... 381/355, 369, 178, 186

See application file for complete search history.

(56) References Cited

U.S. PATENT DOCUMENTS

| | | | | |
|---|---|---|---|---|
| 6,658,133 | B1 * | 12/2003 | Usuki | H04R 13/02 340/388.1 |
| 2006/0153418 | A1 | 7/2006 | Van Halteren | |
| 2012/0099746 | A1 | 4/2012 | Fujise | |
| 2012/0250897 | A1 * | 10/2012 | Michel | H04R 19/04 381/111 |
| 2013/0010981 | A1 | 1/2013 | Harano et al. | |
| 2013/0034239 | A1 * | 2/2013 | Shin | H04R 1/1083 381/74 |

OTHER PUBLICATIONS

European Search Report, 14162182.1, Nov. 3, 2014, 7 pages.

* cited by examiner

*Primary Examiner* — George Monikang

(74) *Attorney, Agent, or Firm* — Edell, Shapiro & Finnan, LLC

(57) ABSTRACT

A microphone module disposed in an electronic device for reducing echo noise. The microphone module includes a casing, a first diaphragm disposed in the casing, a second diaphragm disposed in the casing and a substrate disposed between the first diaphragm and the second diaphragm and joined to the casing to define a first space and a second space which are isolated and separated from each other. The first diaphragm is disposed in the first space, the second diaphragm is disposed in the second space, and the substrate is electrically connected with the first diaphragm and the second diaphragm.

13 Claims, 3 Drawing Sheets

DUAL-DIAPHRAGM MICROPHONE MODULE TO REDUCE VIBRATION NOISE

RELATED APPLICATION DATA

This application claims priority under 35 U.S.C. §119 to Taiwan patent application TW 102133284, filed on Sep. 13, 2013, the disclosure of which is incorporated herein by reference in its entirety.

TECHNICAL FIELD

Background

Today's information society continues to increasingly rely on consumer electronic devices including, but not limited to, smart phones, e-books, and tablet computers, among other devices. These devices enable people to gain access to, for example, the Internet while mobile, or stationary. Such devices also enable people to, e.g., listen to music, and simultaneously run productivity software such as Internet browsers, word processors, graphics programs and the like. One of the particularly notable features of such consumer electronic devices, and one that has increased the popularity of such devices, is the ability to operate the device using voice recognition and voice commands. That is, instead of (or in addition to) using, e.g., a touch screen, in combination with an associated display, or some other form of input device (keyboard, mouse, etc.), a user can control the electronic device by vocalizing commands or asking questions. Unfortunately, in noisy environments, a microphone that detects the audible input to the electronic device might also detect ambient noise (including music or other sounds being played by the electronic device itself), thus making the audible input difficult to interpret.

Accordingly, there is a need for improvements in the operations of sound detection in electronic devices.

SUMMARY

In accordance with certain embodiments presented herein, a microphone module and an electronic device are provided. The microphone module is assembled with the electronic device to capture an audio signal generated by the electronic device. The microphone module includes a casing, a first diaphragm, a second diaphragm, and a substrate. The casing has a first space and a second space that are isolated and separated from each other. The first diaphragm is disposed in the first space. The second diaphragm is disposed in the second space. The substrate is electrically connected with the first diaphragm and the second diaphragm wherein an components of an audio signal drives the first diaphragm and the second diaphragm. The phase of the vibration produced by the first diaphragm and the phase of the vibration produced by the second diaphragm are opposite with respect to one another. In this way, the effects of a vibration component of the audio signal transmitted through, e.g., a chassis of an electronic device can be reduced or eliminated thus reducing an echo of an audible signal generated by the electronic device itself.

BRIEF DESCRIPTION OF THE DRAWINGS

Embodiments are described herein in conjunction with the accompanying drawings, in which.

DESCRIPTION OF EXAMPLE EMBODIMENTS

Figure 1:
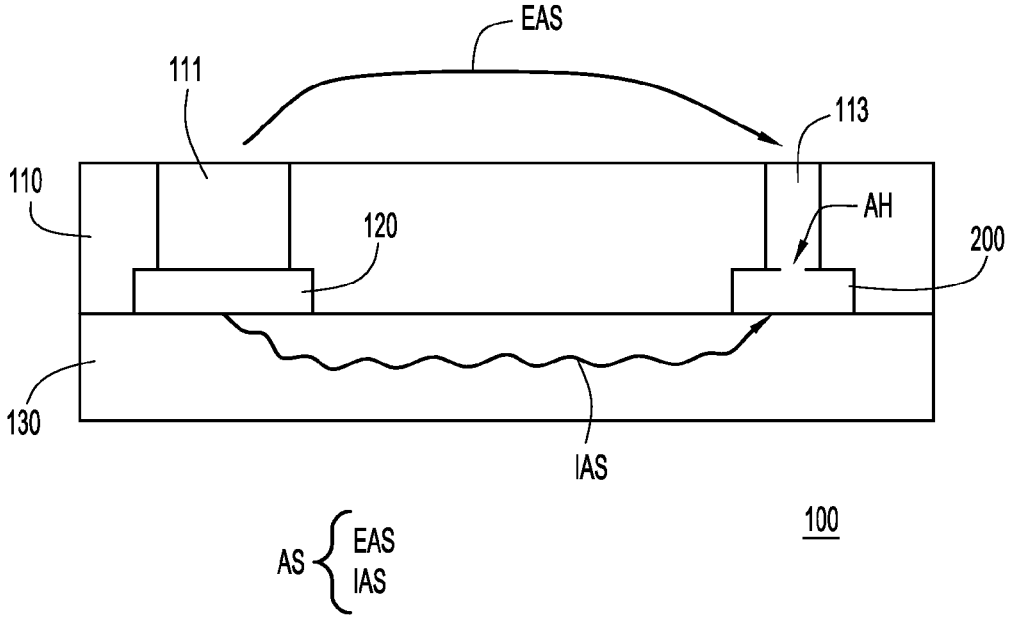
FIG. 1 is a schematic diagram of an electronic device showing how an audio signal, made up of a combination of an external audio signal and an internal audio signal, reaches a microphone in an electronic device.

Reference is made to FIG. 1, which depicts a schematic diagram of an electronic device 100 and further shows how an audio signal (AS), made up of an external audio signal (EAS), which passes through the air, and an internal audio signal (IAS), which is transmitted as vibration via a chassis or inner electronic device structure, reaches a microphone module 200 in the electronic device 100 and which is, in turn, converted to electronic signals representative of the audio signal (AS).

As noted, one of the particularly notable features of electronic consumer devices, and one that has increased the popularity of such devices, is the ability to operate the device using, e.g., voice recognition and voice commands. That is, instead of (or in addition to) using, e.g., a touch screen, in combination with an associated display, or some other form of input device (mouse, etc.), a user can control the electronic device by vocalizing commands or asking questions. Unfortunately, in noisy environments, a microphone that detects the audible command input to the electronic device might also detect ambient noise (including music or other sounds being played by the electronic device itself), thus making the audible input difficult to interpret.

Thus, a main purpose of the present invention is to reduce that part of an audio signal picked up by microphone module 200 that is generated by the electronic device itself. In one embodiment, as will be explained in detail below, the internal audio signal is transmitted through vibration of the chassis of the electronic device and is one form of echo that is reduced or eliminated by operation of the microphone module 200, and in particular, the interaction of electrical signals associated with diaphragms within microphone module 200. Reduction or elimination of echo associated with the external audio signal is also described.

Still with reference to FIG. 1, electronic device 100 may be a smartphone, tablet, notebook, etc. As shown, electronic device 100 includes a body 110, speaker 111, microphone module 200, and other inner structure such as a chassis 130, printed circuit board or screen (not shown), among other components. Speaker 120 is configured to vibrate to generate and audibly play out an audio signal (AS). That audio signal may be received by microphone module 200. As noted, microphone module 200 may also receive other ambient audio signals. However, embodiments described herein are directed to reducing or eliminating echo sound (i.e., sound generated by speaker 120 itself, by reducing or eliminating aspects of the IAS and the EAS).

When speaker 120 plays an audio signal (AS), an audible component thereof passes through, e.g., the air, and through sound channel 111 as the external audio signal (EAS). Microphone module 200 receives the EAS via a receive channel, including an air hole (AH) 113, associated with microphone module 200. In addition, when speaker 120 plays an audio signal, speaker 120 also causes chassis 130 to vibrate as a result of being physically connected to chassis 130, or some other inner structure of electronic device 100. Such vibration, referred to herein as the internal audio signal (IAS), is also received by the microphone module 200 and detected thereby. That is, when microphone 120 plays an audible sound, that sound is transmitted through the air and through the chassis of the electronic device causing a movable diaphragm within microphone module 200 to vibrate accordingly. That diaphragm vibration results in an electrical signal being output by the microphone module 200 that is representative of the overall audio signal AS (EAS+IAS).

Figure 2:
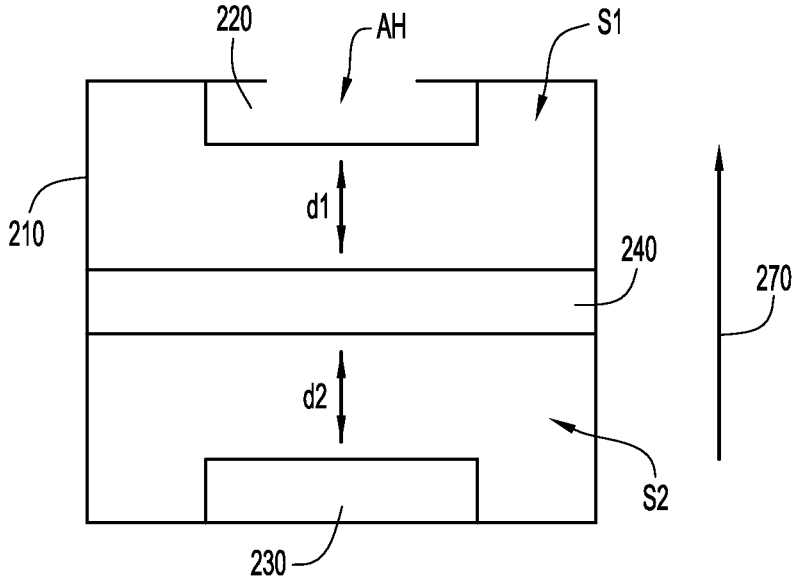
FIG. 2 is a schematic diagram of a dual-diaphragm microphone module in accordance with an embodiment of the present invention.

FIG. 2 is a schematic diagram of a dual-diaphragm microphone module 200 in accordance with an embodiment of the present invention. Microphone module 200 may be configured as, e.g., a capacitive microphone, and, in an embodiment, includes a housing 210, a first diaphragm 220, a second diaphragm 230, and a substrate 240. A first space S1 and a second space S2 are defined by housing 210 and substrate 240 and are isolated from each other as shown.

As configured, first diaphragm 220 and second diaphragm 230 are on opposite sides of the substrate 240, and they are electrically connected to substrate 240. That is, in a capacitive microphone as shown in FIG. 2, a first electrical plate is formed by each diaphragm 220, 230, and a second electrical plate is formed by substrate 240. Thus, a change in electrical capacitance can be detected between first diaphragm 220 and substrate 240, and separately between second diaphragm 230 and substrate 240 when the diaphragms vibrate. It is noted that microphone module 200 can be configured as a 3-wire device (one wire for each diaphragm and one wire for a shared substrate) or a 4-wire device (one wire for each diaphragm and one wire for each side of the substrate).

In the instant embodiment, air hole AH is formed in housing 210 and is open to first space S1 thereby permitting the external audio signal (EAS) to reach first diaphragm 220 via the air hole (AH). Because second space S2 is isolated from first space S1, only first diaphragm 220 is influenced by the external audio signal (EAS). However, if the overall audio signal also includes an internal audio signal (IAS) component, then both first diaphragm 220 and second diaphragm 230 are influenced at the same time since housing 210 is, e.g., mounted to chassis 130. Significantly, however, because first diaphragm 220 and second diaphragm 230 are arranged opposite to each other in the manner shown, when an internal audio signal (IAS) component is received, the diaphragms will vibrate in opposite directions with respect to one another.

For example, consider a substantially instantaneous movement upward of microphone module 200, as indicated by arrow 270. Due to inertia, the distance d1 between diaphragm 220 and substrate 240 will momentarily decrease, whereas the distance d2 between diaphragm 230 and substrate 240 will momentarily increase. As a result, the overall capacitive change generated by microphone module 200 due to the internal audio signal component will be negligible or absent due to the offsetting distances d1, d2 (i.e., one distance increases while the other decreases for a given movement of microphone module 200).

Stated alternatively, an output signal of microphone module 200 based on a received internal audio signal (IAS) is based on the relationship between first diaphragm 220 and second diaphragm 230 and substrate 240. Because of the structural arrangement of microphone module 200, the vibrations of first diaphragm 220 and second diaphragm 230 have opposite phases with respect to each other. Consequently, the electrical signals generated by first diaphragm 220 and second diaphragm 230 (in association with substrate 240) can offset each other, and cancel the effect of the received internal audio signal (IAS).

Figure 3:
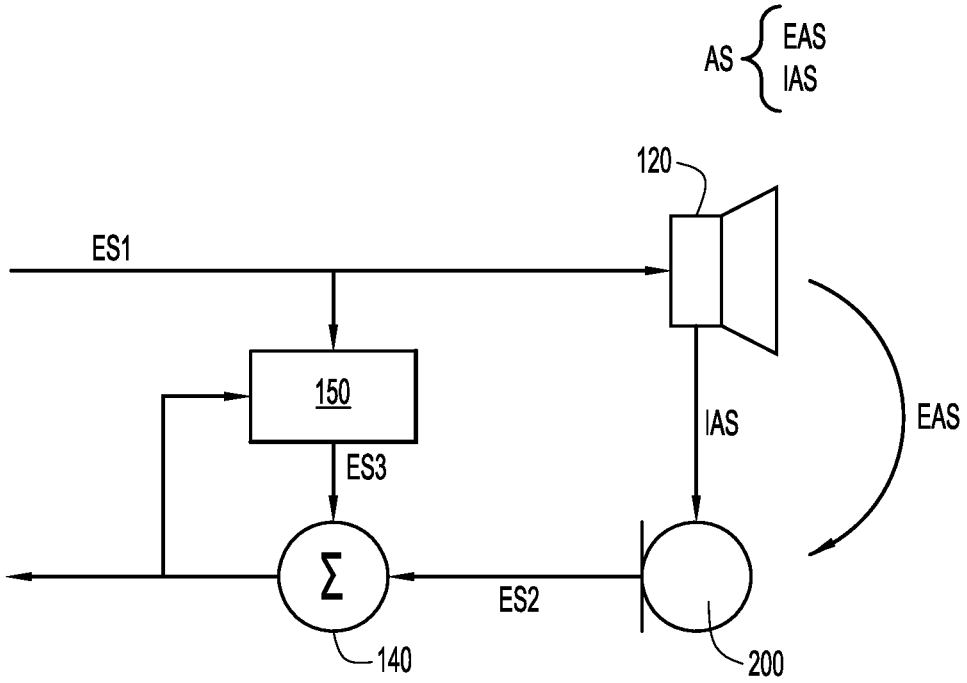
FIG. 3 is a block diagram of an example circuit for performing echo cancellation in accordance with an embodiment of the present invention.

As noted, a goal of the present invention is to reduce or eliminate not only a signal associated with an internal audio signal (e.g., chassis vibration), but also to reduce or eliminate the external audio signal (EAS) so as to improve the overall interpretation of any audible command input to electronic device 100. In this regard, FIG. 3 shows a block diagram of an example circuit for performing echo cancellation in accordance with an embodiment of the present invention. Specifically, to play sound, speaker 120 translates a first electric signal ES1 to generate the audio signal (AS). As previously explained, audio signal (AS) can be divided into an external audio signal (EAS) component and an internal audio signal (IAS) component.

Microphone module 200 receives both such components. As explained above, the internal audio signal (IAS) component of the audio signal is reduced or eliminated by the microphone module 200 itself, due to the offsetting interaction of first diaphragm 220 and second diaphragm 230. As a result, second electric signal ES2 output from microphone module 200 comprises substantially only electrical signals representative of the external audio signal, as well as signals representative of voice command inputs and/or other ambient noise that are not intended to be impacted by the operations discussed herein. Thus, for purposes of the instant discussion, electric signal ES2 is to be considered to include only those electric signals representative of external audio signal (EAS).

In accordance with an embodiment of the present invention, to reduce or eliminate the electrical signal ES2, electronic device 100 also includes an echo cancellation unit 150 and a signal processor unit 140. Echo cancellation unit 150 is in communication with signal processor unit 140 and speaker 120. Echo cancellation unit 150 is configured to convert the first electric signal ES1 to a third electric signal ES3. The third electric signal may be an attenuated, delayed and or phase shifted version of electric signal ES1 in order to destructively combine with electric signal ES2. Signal processor unit (140) is configured to receive and process the third electric signal ES3 and the second electric signal ES2 in order to reduce or eliminate the external audio signal (EAS) component (or echo) of the audio signal (AS) in electric signal ES2. A feedback loop is further provided as shown to enable dynamic adjustment of electric signal ES3.

Figure 4:
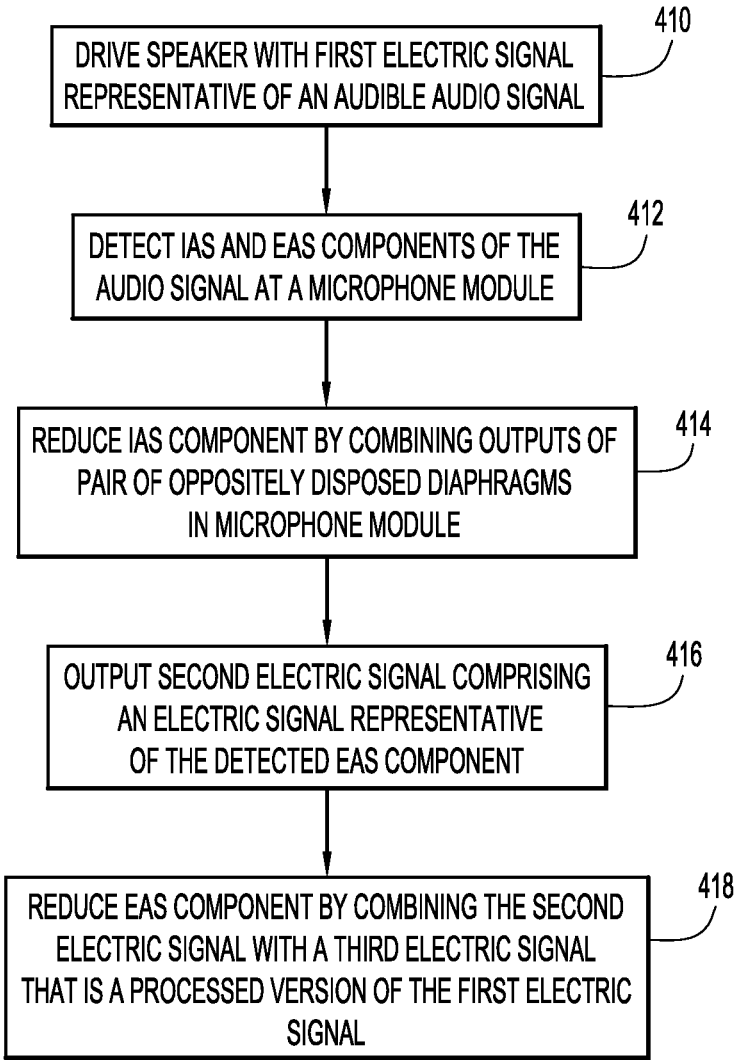
FIG. 4 is a flow chart illustrating example processing steps performed by an electronic device in accordance with an embodiment of the present invention.

FIG. 4 is a flow chart illustrating example processing steps performed by an electronic device in accordance with an embodiment of the present invention. The following process steps are consistent with the circuit configuration shown in FIG. 3. At 410 a speaker is driven with a first electric signal representative of an audible audio signal. At 412, internal audio signal and external audio signal components generated by the speaker are detected at a microphone module. At 414, the internal audio signal component is reduced by combining outputs of a pair of oppositely disposed diaphragms in the microphone module. At 416, the microphone module outputs a second electric signal comprising electric signals representative of the detected external audio signal component. At 418, the external audio component detected by microphone module is reduced by combining the second electric signal with a third electric signal that is a processed version of the first electric signal.

Referring again to FIG. 3, in a preferred implementation, electric signals ES1, ES2 and ES3 may be converted to digital signals for purposes of processing the same in echo cancellation unit 150 and signal processor unit 140. Suitable analog to digital converters may be used as appropriate, as will be appreciated by those skilled in the art.

In sum, in the described embodiments, the internal audio signal (IAS) can be offset by the relationship between first diaphragm 220 and second diaphragm 230 (i.e., the diaphragms are oppositely disposed), thus facilitating the processing of the external audio signal (EAS) that is output by microphone module 200 as second electric signal ES2. Accordingly, the present invention can address undesirable echo effects resulting from chassis 130 vibration, and thereby reduce the computational burden of the electronic device 100, and improve the sound quality and audible command input interpretation.

It is noted that echo cancellation unit 150 and signal processor unit 140 may be implemented as, e.g., a central processing unit (CPU), or other programmable general purpose or special-purpose microprocessor, digital signal processor (DSP), programmable controller, application specific integrated circuits (ASIC), programmable logic devices (PLD) or other suitable processor capable of performing functionality described herein. Echo cancellation unit 150 and signal processor unit 140 may also be in communication with suitable memory that stores logic instructions that can be accessed by echo cancellation unit 150 and signal processor unit 140, as needed. Such memory may in the form of random access memory (RAM), dynamic RAM (DRAM), among other forms of memory.

The above description is intended by way of example only.

What is claimed is:

1. A microphone module, comprising:

a casing;

a first diaphragm disposed in the casing;

a second diaphragm disposed in the casing; and a substrate disposed between the first diaphragm and the second diaphragm and joined to the casing to define a first space and a second space which are isolated and separated from each other, wherein the first diaphragm is disposed in the first space, the second diaphragm is disposed in the second space, and the substrate is electrically connected with the first diaphragm and the second diaphragm, wherein the casing includes an air hole, the first diaphragm is exposed to the air hole and is directly opposite thereto, and the second diaphragm is not exposed to the air hole such that only the first diaphragm is influenced by an external audio signal.

2. The microphone module of claim 1, wherein the microphone module is mounted on a chassis.

3. The microphone module of claim 2, wherein the first diaphragm is vibrated as a result of a sound signal passing through the air hole and as a result of vibration of the chassis.

4. The microphone module of claim 2, wherein the second diaphragm is vibrated only as a result of vibration of the chassis.

5. The microphone module of claim 2, wherein the first diaphragm and the second diaphragm are arranged such that the first diaphragm and the second diaphragm vibrate in opposite phases with respect to each other when the chassis vibrates.

6. The microphone module of claim 1, in combination with an electronic device that comprises an echo cancellation circuit.

7. The microphone module of claim 6, wherein the echo cancellation circuit is configured to operate to eliminate substantially only on an external audio signal generated by a speaker of the electronic device.

8. The microphone module of claim 6, wherein the electronic device is one of a smart phone, an e-book, or a computer.

9. A method for operating an electronic device, the electronic device comprising a speaker and a microphone module both mounted on a chassis of the electronic device, the method comprising:

driving the speaker with a first electric signal representative of an audible audio signal;

detecting, at the microphone module, an internal audio signal component and an external audio signal component of the audible audio signal, the internal audio signal component resulting from vibration of the chassis of the electronic device; and reducing an electric signal representative of the internal audio signal component by combining outputs of a pair of oppositely disposed diaphragms in the microphone module, wherein a first diaphragm of the microphone is disposed in a first space and is directly opposite an air hole, a second diaphragm is disposed in a second space isolated from the first space and without an air hole, the first and second diaphragms being oppositely disposed, and wherein only the first diaphragm is influenced by the external audio signal through an air hole.

10. The method of claim 9, wherein detecting comprises detecting the internal audio signal component with the first and second diaphragms.

11. The method of claim 9, further comprising outputting, from the microphone module, a second electric signal representative of the external audio signal component detected in the step of detecting.

12. The method of claim 11, further comprising reducing the external audio signal component by combining the second electric signal with a third electric signal that is a processed version of the first electric signal.

13. The method of claim 11, further comprising generating the third electric signal by at least one of attenuating, delaying or phase shifting the first electric signal.

* * * * *